US005593251A

United States Patent [19]

Gillen

[11] Patent Number: 5,593,251

[45] Date of Patent: Jan. 14, 1997

[54] METHOD OF INSTALLING A COMPOSITE TIMBER AND CONCRETE PILE

[75] Inventor: Gerard Gillen, Harvey, La.

[73] Assignee: Gillen Pile Driving, Inc., Harvey, La.

[21] Appl. No.: 168,424

[22] Filed: Dec. 17, 1993

[51] Int. Cl.[6] ..... E02D 5/26

[52] U.S. Cl. ..... 405/250; 405/232

[58] Field of Search ..... 405/250, 251, 405/252, 253, 254, 255, 256, 257, 232

[56] References Cited

U.S. PATENT DOCUMENTS

| | | | |
|---|---|---|---|
| 1,471,124 | 10/1923 | Handl . | |
| 1,588,516 | 6/1926 | Barnes | 405/257 |
| 1,759,786 | 5/1930 | Hardin | 405/250 |
| 2,821,069 | 1/1958 | Fox | 405/250 |
| 2,874,546 | 2/1959 | Fox | 405/250 |
| 2,912,829 | 11/1959 | Cobi | 405/250 |
| 3,003,323 | 10/1961 | Holt | 61/53 |
| 3,720,068 | 3/1973 | De Rosa . | |
| 3,762,173 | 10/1973 | Marsh | 61/53 |
| 3,802,206 | 4/1974 | Moore et al. . | |
| 4,032,244 | 6/1977 | Quayle | 403/286 |
| 4,102,141 | 7/1978 | Ingalls | 61/53 |
| 4,252,473 | 2/1981 | Thomas et al. | 405/250 |
| 4,431,347 | 2/1984 | Gillen, Jr. | 405/251 |
| 4,525,102 | 6/1985 | Gillen | 405/232 |
| 4,547,096 | 10/1985 | Daigle et al. | 405/251 |

*Primary Examiner*—Dennis L. Taylor

*Attorney, Agent, or Firm*—Pravel, Hewitt, Kimball & Krieger

[57] ABSTRACT

A method for installing a composite timber and concrete piling system provides metallic tube that is partially filled with concrete. The unfilled portion of the metallic tube defines a splice member when the metallic tube is driven into a timber pile. The timber pile member is first driven into the earth at a selective position and at a selective orientation but a partial distance which leaves a small portion of the timber pile exposed above ground. The metallic tube is then placed on top of and aligned with the axis of the timber pile. The unfilled portion of the metallic tube forms a splice. The concrete filled metallic tube is forced downwardly until the unfilled portion of the tube is embedded into the exposed portion of the timber pile and wherein the concrete in the tube approaches the top of the timber pile. During driving, the concrete in the tube contacts the top of the timber pile.

4 Claims, 2 Drawing Sheets

METHOD OF INSTALLING A COMPOSITE TIMBER AND CONCRETE PILE

BACKGROUND OF THE INVENTION

1. Field of the Invention

The present invention relates to piling and pile driving and more particularly relates to an improved composite timber and concrete pile construction. Even more particularly, the present invention relates to an improved method for installing composite pile constructions which include a lowermost timber pile section and an uppermost concrete pile section wherein the timber pile section is first driven below the earth's surface a distance, leaving a small portion exposed. A hollow steel, tubular sleeve is partially filled with concrete and allowed to set. The concrete pile and steel tube is then joined to the top of the timber pile. The unfilled portion of the steel tubular sleeve defines a connector that is embedded in the top of the timber pile. The assembly is then driven into the ground.

2. General Background

In various areas of the country where bearing pressures of soil are low and/or unsuitable for building purposes, construction can employ the use of one or more elongated load carrying elements referred to in the industry as a pile or piling. These devices for transferring load between a building and the underlying earth can be concrete, steel, or timber, in construction.

Timber piling are usually somewhat restricted in length because of the very nature of their source, namely trees. Thus it is desirable to splice piling together to form piling of extended length. These timber pilings can also vary in diameter from end to end, complicating the splicing operation. Timber piling above the water line is generally more prone to rotting. Thus, it is desirable to use a concrete pile above the water line when composite piling are used.

Often times timber pile are combined with piling of other construction such as, for example, concrete. U.S. Pat. No. 3,003,323 issued to A. R. Holt provides a "Composite Pile Connector." A "Pile Splicer" is also the subject of U.S. Pat. No. 3,802,206 issued to Robert Moore, et al. In the patent a splicing means for connecting two wood piles end to end to make a long pile for the transfer of pile loads to a lower stronger ground is disclosed. The splicer in that patent provides a plate-like, substantially horizontal element adapted to lie between adjacent pile ends. Optional epoxy glue between the upper and lower surfaces can be provided between the element and the upper and lower piles. A central upright dowel member extends above and below the plate-like element driven into each pile element respectively. The Moore patent contemplates a driving of the entire pile assembly after splicing. This is unlike the present invention where the second pile section is added after the first lowermost pile section is already driven to its final position.

A "Composite Pile and Method of manufacture" is the subject of U.S. Pat. No. 4,252,473 issued to Albert M. Thomas, et al. The composite section includes a wooden section and a helically corrugated shell secured to the wooden section by a transition fitting. The corrugated steel carries a splice element that connects with the timber pile section. After driving, a liquid slurry of unhardened concrete can be added to the bore of the corrugated shell. Thus, the shell acts as a form for the concrete. A composite concrete and timber pile is the subject of U.S. Pat. No. 1,471,124 entitled "Means of connecting Ferro or Reinforced Concrete Piles to Wooden Piles." "Composite Piles and Joiners Therefore" is the subject of U.S. Pat. No. 2,912,829 issued to W. H. Cobi. The Cobi patent shows a composite concrete and timber pile with a splice element therefore.

A "Method and Apparatus for splicing Replacement Pile Sections to a Pile Stub" is the subject of U.S. Pat. No. 3,720,068 issued to E. r. DeRosa. That patent, however, deals with metal pile sections which are repaired with another metal pile section.

A splice element for two wooden utility poles, for example, is provided in U.S. Pat. No. 4,032,244. The extension would be attached to the flatten top of an existing pole. A projecting center shaft extends for the bracket to be received within mating center bores provided in the utility pole, a wooden extension pole or both. Threaded fasteners and metal straps complete the interconnection between the existing pole and the extension pole.

A "Pile Coupling and a Method of Pile Driving" is seen in U.S. Pat. No. 3,762,173 issued to Richard Marsh. The patent discloses a means for coupling sections of pile and a method of driving pile utilizing a thin-wall composite pile section. the coupling comprises a thin-wall sleeve with a telescoping thick-wall rings or collar mechanically anchored within the sleeve. Taps integrally formed in the collar, or the entire collar itself, are expanded within the sleeve to form correspondingly anchor pots in the sleeve thereby mechanically interlocking the collar and sleeve. The coupling is adapted for use in coupling successive sections of thick-wall tubular pile or in coupling thin-wall tubular composite pile or thick-wall tubular pile. Use of the thin-wall tubular composite pile enables employment of a method for driving which eliminates the necessity for retaining a succeeding thick-wall tubular pile after the initial one is driven home.

U.S. Pat. No. 3,003,323 issued to A. R. Holt entitled "Composite Pile Connector" shows a connector for use with a lower second of wood and an upper section of metallic pipe as part of a composite pile assembly. the connector includes a metallic ring having two plates disposed as chords within the ring, each chordal plate meeting at one end with the other so as to form the apex of a V with one leg on each side of the center of the ring. The plates are welded to the ring and the plates are of a length greater than the radius of the rings. The plates serve to displace the wood of a wood pile so as to wedge it tightly within the ring. This is unlike the present invention which uses a precast, hardened reinforced concrete pile as the upper pile section and joins that section to a lowermost timber pile section as part of a composite pile structure.

Daigle et al., U.S. Pat. No. 4,547,096 entitled "Alignment of Tubular Piles for Joinder," provides a method of alignment for two tubular piles. The aligner extends from one end of the tubular pile for insertion into the other tubular pile. One or more shim members are disposed between and in engagement with the outer surface of the aligner extended portion and the inner surface of the outer tubular pile when the extended portion is inserted therein for maintaining the tow piles in alignment for joinder. This patent differs from the present invention because it does not contemplate the joining of a reinforced concrete and timber pile as part of a composite section.

Applicant also is the patentee of a prior U.S. Pat. No. 4,431,347 issued Feb. 14, 1984, and entitled "Composite Timber Pile System". In that prior Gillen patent, a method of driving composite timber pile sections provides a pair of timber pile sections, the first of which is driven into the earth a distance leaving the butt of the pile exposed. A splice element is embedded into the remaining pile section and leveling material is added to the top of the first pile section.

Applicant's prior U.S. Pat. No. 4,525,102 entitled "Timber Pile Connection System" provides a method of driving composite timber pile sections which provides a pair of timber pile sections, the first of which is driven into the earth a distance leaving the butt of the pile exposed. A splice element is embedded into the remaining pile section and leveling material is added to the top of the first pile section. Upon assembly and during driving, the leveling material is laterally confined with the splice element while the respective mating surfaces of the two pile sections confine the leveling material vertically with the leveling material thus transferring compressive forces between the two pile sections. The splice element is a cylindrical element having a hollow bore which during operation contains the leveling material. The prior Gillen patent differs from the present invention in that it contemplates a driving of the composite pile section. further, the first timber pile section is driven a distance downwardly, but leaving the butt portion of the pile exposed so that the splice element and leveling material can be added. This is unlike the present invention wherein the lowermost pile section is driven well below the earth's surface, and in fact a distance substantially equal to the length of the second pile section which is of reinforced concrete rather than timber.

A method of driving composite piles is seen in the Ingalls U.S. Pat. No. 4,102,141. In that patent, a composite pile structure is formed from a lower wooden section and an upper tubular metal section which is connected to the wood member and then filled with concrete. The wooden section is first started into the ground a desired distance and the metal section is then supported by the upper end of the wooden member. A mandrel member is located in driving engagement with the upper end of the metal section and the lower end of the mandrel is supported in space relation to the wooden member. Initial hammer energy of limited intensity is applied to drive the metal section into the wooden member until the bottom of the mandrel comes into contact with the top of the wooden member. Thereafter, hammer energy of greater intensity is applied to the connected sections and concentrated against the surface of the wooden member enclosed by the embedded metal section. The method contemplates liquid slurried concrete to be added to the metal section after the composite pile is driven to the desired depth. This is unlike the present invention wherein a precast, hardened reinforced concrete pile section is connected to the lowermost timber pile section after the lowermost timber pile section is driven fully to its elevational position, usually well below the surface.

SUMMARY OF THE PRESENT INVENTION

The present invention provides a time saving and labor saving improved method of installing a composite timber and concrete-pipe pile system. The method utilizes a timber pile section and a concrete and steal pile section. Initially, a metal tube is partially filled with concrete. The concrete extends fully the length of the tube to the lower end portion. However, at the upper end portion of the tube, the tube is only partially filled to define and unfilled portion of for example four—six inches (4"–6") in length in tubing. This leaves a cylindrically shaped void at the upper end portion of the inside of the tube. The tube can be supported in a vertical position during the fill so that gravity can be used to fully settle the concrete within the tube and the concrete seeks its natural level, leaving the unfilled portion at the top.

An annular cutting edge is formed on the upper end portion of the metallic tube adjacent the unfilled portion.

A timber pile member is then driven into the earth at a selective position and a partial distance which leaves about a foot of the timber piling exposed by ground. A sand or grouting leveling material can be placed atop the driven timber pile butt, before the metallic tube forms a connection therewith (for example, a layer ½"–2" thick of leveling material). The metallic tube is then placed on the exposed portion of the timber pile wherein the central longitudinal axis of each pile member is aligned. This places the unfilled portion of the metallic tube on the top of the timber pile. The unfilled portion of the metallic tube acts a splice. The metallic tube is then driven into the exposed portion of the timber pile until the concrete meets the top or the top of the leveling material which is resting on top of the timber pile. The layer of leveling material (eg. sand) is optional. This operation embeds the unfilled portion of the tube fully in the top of the timber pile. During driving however, the concrete pile abuts and transfers load to the timber pile.

The assembly of the metallic tube filled with concrete and timber pile can then be driven into the earth.

The metallic tube is preferably a steal, generally cylindrically shaped tube.

In the preferred method, an annular cutting edge is formed on the upper end portion of the metallic tube adjacent the unfilled portion of the metallic tube.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
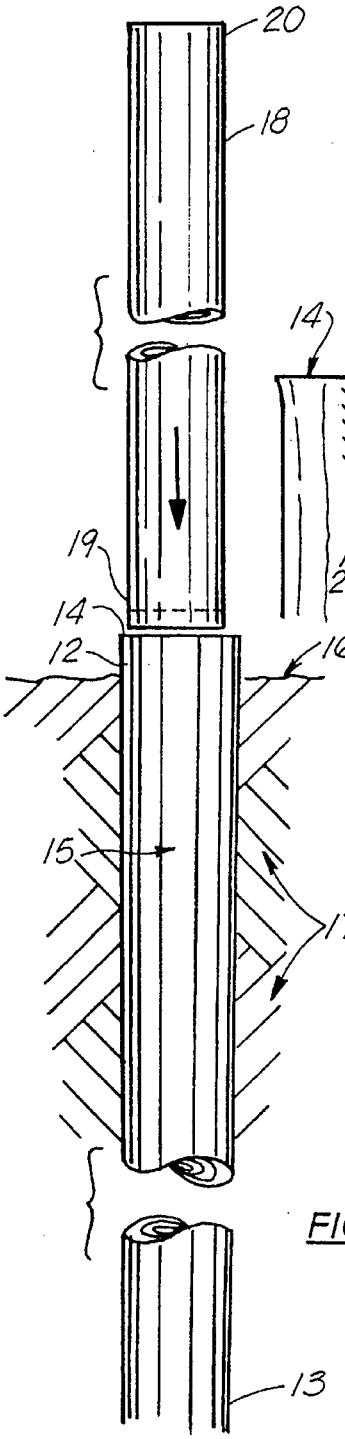
FIG. 1 is an elevational view of the preferred embodiment of the apparatus of the present invention and prior to a driving of concrete and steel composite pile section end to the timber pile section.
Figure 2:
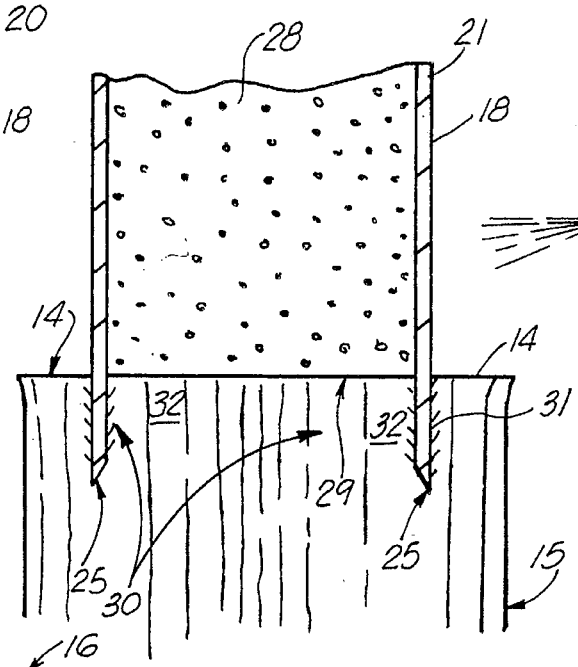
FIG. 2 is a fragmentary sectional elevational view of the preferred embodiment of the apparatus of the present invention.
Figure 3:
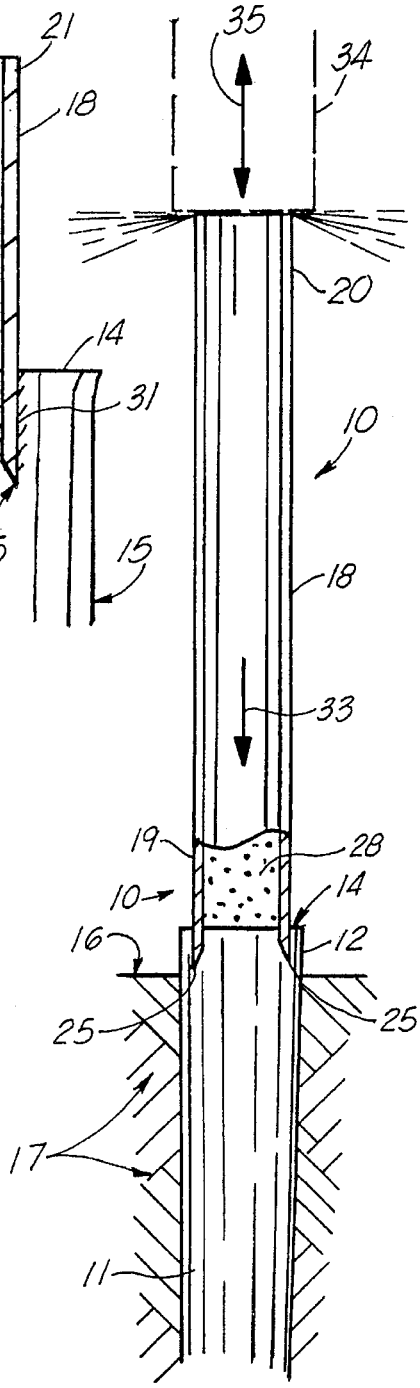
FIG. 3 is a sectional elevational view of the preferred embodiment of the apparatus of the present invention shown during a driving thereof.

FIGS. 1–3 show generally the preferred embodiment of the apparatus of the present invention designated generally by the numeral 10. The present invention provides an improved composite piling apparatus 10 that includes a lower timber section 11 and an upper composite section of steel and concrete. The lower timber section includes an upper end portion 12, and lower end portion 13, and a generally flat circular top surface 14. Timber section 11 is typically cylindrically shaped, but being a of a larger diameter at upper end portion 12 and of a slightly lower diameter at lower end portion 13. Outer surface 15 is generally cylindrically shaped, but can be frustroconically shaped since upper end 12 is generally of a larger diameter of lower end portion 13.

Figure 7:
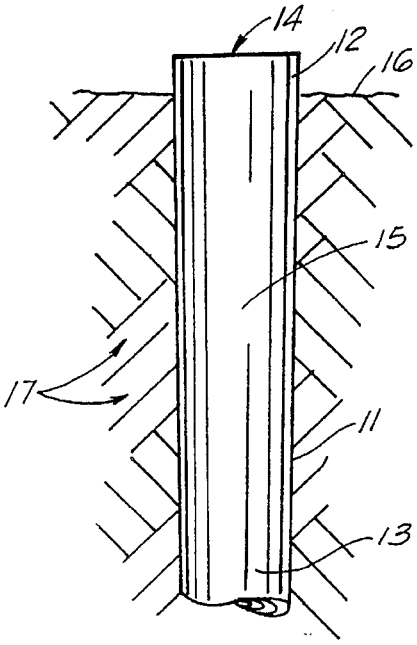
FIG. 7 is a partial sectional elevational view of the preferred embodiment of the apparatus of the present invention and illustrating the initial methods step of the present invention.

As an initial method step (see FIG. 7) timber section 11 is driven into the earth's surface and into the surrounding formation 17 beneath the earth's surface 16. However, a small portion (about one foot in length) of the upper end portion 12 of timber section 11 is left exposed above the earth's surface 16 as shown in FIG. 7. A metallic tube 18 that has been partially filled with concrete (and allowed to harden) is then placed vertically above timber section 11 and aligned therewith so that the central longitudinal axis 36 of timber section 11 is coaxial and aligns with the central longitudinal axis 37 of metallic tube 18. The unfilled portion of the metallic tube becomes a pile connector or splice. A layer of leveling material (eg. sand) can be placed inside the metallic tube, above the surrounded portion 32 of timber pile section 11.

Figure 4:
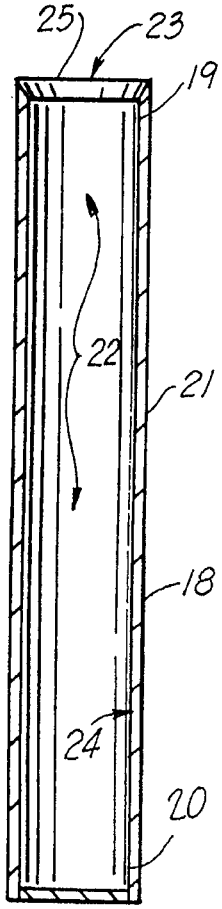
FIG. 4 is a sectional elevational view of the metallic tube portion of the preferred embodiment of the apparatus of the present invention.
Figure 5:
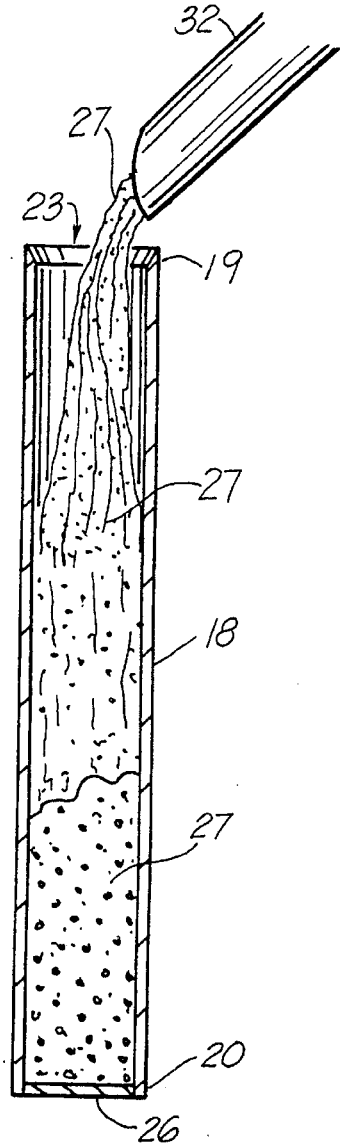
FIG. 5 is a sectional elevational view illustrating a step in the method in the method of the apparatus of the present invention.
Figure 6:
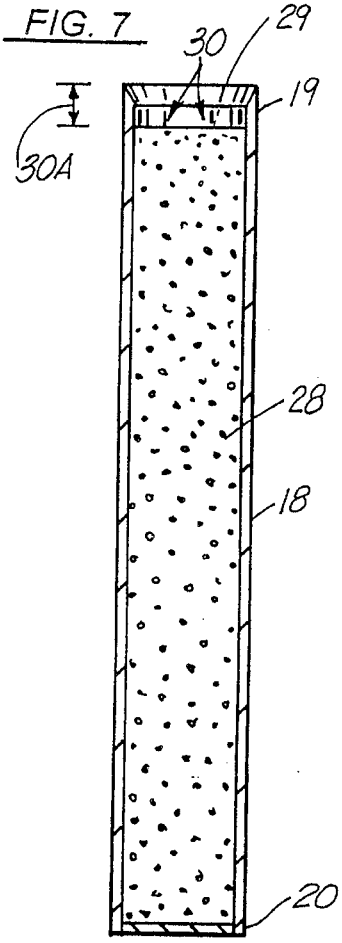
FIG. 6 is another sectional elevational view illustrating a method step in the method of the present invention.

FIGS. 4, 5 and 6 illustrate the method steps of the present invention that relate to the addition of concrete to metallic tube 18 and the preparation of a lower end portion 19 of metallic tube 18 as a cutting edge for forming a splice between metallic tube 18, and timber pile 11 for driving.

Metallic tube 18 is preferably steal tube having a diameter of between six and twelve inches ("–12"). The lower end portion 19 is inverted during the method step of adding slurried concrete to the inner bore 22 of metallic tube 18 (see FIGS. 4 and 5). The inverted metallic tube 18 places the upper end portion 20 on a floor or the like for supporting the tube 18 during the pour. It should be understood that the upper end portion 20 can be sealed using a circular transverse plate 26 that is welded thereto. Alternatively, the upper end portion 20 can remain open. A rubber or wooden pad is placed under tube 18 during the pour of FIG. 4.

The lower end portion 19 of metallic tube 18 is preferably beveled, being cut to provide an annular beveled edge 25 that defines a sharp edge for cutting into the upper end portion 12 of timber section 11 during use.

When the metallic tube 18 is in an inverted position (FIGS. 4–6), flowing slurried concrete 27 is pumped via chute 38 into the bore 22 (FIG. 5). However, the concrete 27 is added until the metallic tube 18 is almost filled, but leaving an unfilled area 30 between beveled edge 25 and a distance of about six to twelve inches (6"–12") therefrom as shown in FIG. 6. The arrow 30A in FIG. 6 indicates the dimension of about 6 inches of unfilled area 30 between annular beveled edge 25 and concrete surface 29.

After flowing concrete has been added to the bore 22 of metallic tube 18, the concrete is allowed to set. Hardened concrete 28 thus conforms to the bore 22. Upon hardening, the concrete presents a transverse flat face 29 to the opening 23 at the lower end portion 19 of metallic tube 18. After setting, the metallic tube 18 containing hardened concrete 28 is ready to be added to timber pile section 11 as part of the method of the present invention.

In FIGS. 2 and 3, a section 31 of the tube wall is embedded in the upper end 15 of timber pile 11. Annular beveled edge 25 penetrates timber pile section 11 at top surface 14 and penetrates until concrete surface 29 registers against and abuts top surface 14 of timber section 11. In this position (FIGS. 2 and 3) the piling apparatus 10 is ready to be driven. Embedded tube wall section 31 surrounds a portion 32 of timber pile section 11. In FIG. 3, arrow 33 indicates a downward movement of the composite pile includes timber section 11 metallic tube 18 and its hardened concrete interior 28. Driver 34 can be any commercially available pile driver that can be used with timber and/or concrete piling. Arrow 35 in FIG. 3 indicates up and down movement of the pile driver 34 during an insertion of the composite piling 10 into the earth's surface 16 and surrounding formation 17. During this driving and after driving is completed, the central longitudinal axis 36 of timber section 11 is aligned with the central longitudinal axis 37 of metallic tube 18.

The following table lists the part numbers and part descriptions as used herein and in the drawings attached hereto.

PARTS LIST

| Part Number | Description |
|---|---|
| 10 | composite piling |
| 11 | timber section |
| 12 | upper end portion |
| 13 | lower end portion |
| 14 | top surface |
| 15 | cylindrical outer surface |
| 16 | earth's surface |
| 17 | surrounding formation |
| 18 | metallic tube |
| 19 | lower end portion |
| 20 | upper end portion |
| 21 | cylindrical side wall |
| 22 | bore |
| 23 | opening |
| 24 | inside surface |
| 25 | annular beveled edge |
| 26 | plate |
| 27 | flowing concrete |
| 28 | hardened concrete |
| 29 | concrete surface |
| 30 | unfilled area |
| 30A | arrow |
| 31 | embedded tube wall section |
| 32 | surrounded portion |
| 33 | arrow |
| 34 | driver |
| 35 | arrow |
| 36 | central longitudinal axis |
| 37 | central longitudinal |
| 38 | chute |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A method of installing a composite timber and concrete piling system at a job site comprising the steps of:

a) partially filling a vertically extending metallic cylindrical tube with concrete, wherein the concrete extends to the lower end of the tube and wherein the concrete approaches but does not reach the upper end of the tube to define an unfilled portion, the unfilled portion forming a connector portion;

b) allowing the concrete to set over an extended period of time prior to use at the job site;

c) field driving a timber pile member into the earth at the job site at a selected position and a partial distance which leaves a small portion of the timber pile exposed above ground;

d) inverting the tube after the concrete has set;

e) placing the inverted metallic tube on the exposed portion of the timber pile at the job site;

f) forcing the metallic, concrete filled tube downward until the unfilled portion is imbedded into the exposed portion of the timber pile, and wherein the concrete in the tube approaches the top of the timber pile; and g) driving the metallic tube to force the assembly of the metallic tube and timber pile into the earth.

2. The methods of claim 1 further comprising the step between steps "a" and "b" of forming an annular cutting edge in the upper end of the metallic tube.

3. The method of claim 1 wherein in step "b" the tube is maintained in a generally vertical position until the concrete is set.

4. A method of installing a composite timber and concrete piling system comprising:

a) partially filling a vertically extending cylindrical tube with concrete, wherein the concrete extends fully to one end of the tube and wherein the concrete approaches but does not reach the other end of the tube to define an unfilled portion, the unfilled portion of the tube forming a connector portion;

b) allowing the concrete to set over an extended period of time prior to use at the job site;

c) driving a timber pile member into the earth at the job site at a selected position and a partial distance which leaves a small portion of the timber pile exposed above ground, and wherein the diameter of exposed portions of the timber pile is larger than the unfilled portion of the tube;

d) inverting the tube well after the concrete has set so that the unfilled portion can be joined to the timber pile;

e) placing unfilled portion of the inverted metallic tube on the exposed portion of the timber pile;

f) forcing the metallic, concrete filled tube downward until the unfilled portion is imbedded into the exposed portion of the timber pile, and wherein the concrete in the tube engages the top of the timber pile;

g) driving the metallic tube to force the assembly of the metallic tube and timber pile into the earth; and h) wherein in step "g" the set concrete and tube carry the load generated during driving.

* * * * *